US007576697B2

(12) United States Patent
Chen et al.

(10) Patent No.: US 7,576,697 B2
(45) Date of Patent: Aug. 18, 2009

(54) DUAL POLARIZATION ANTENNA DEVICE FOR CREATING A DUAL BAND FUNCTION

(75) Inventors: Chih-Ming Chen, Neipu Township, Pingtung County (TW); Min-Sheng Ma, Jhunan Township, Miaoli County (TW); Yuch-Pi Huang, Jhunan Township, Miaoli County (TW)

(73) Assignee: Inpaq Technology Co., Ltd., Hsinchu (TW)

( * ) Notice: Subject to any disclaimer, the term of this patent is extended or adjusted under 35 U.S.C. 154(b) by 0 days.

(21) Appl. No.: 11/905,991

(22) Filed: Oct. 9, 2007

(65) Prior Publication Data

US 2009/0091498 A1 Apr. 9, 2009

(51) Int. Cl.
*H01Q 1/38* (2006.01)
*H01Q 5/00* (2006.01)
*H01Q 9/04* (2006.01)

(52) U.S. Cl. ..... 343/700 MS

(58) Field of Classification Search ..... 343/700 MS
See application file for complete search history.

(56) References Cited

U.S. PATENT DOCUMENTS 5,241,321 A * 8/1993 Tsao ..... 343/700 MS
5,703,601 A * 12/1997 Nalbandian et al. ... 343/700 MS
5,952,971 A * 9/1999 Strickland ..... 343/700 MS
6,201,501 B1 * 3/2001 Arkko et al. ..... 343/702
6,549,166 B2 * 4/2003 Bhattacharyya et al. ..... 343/700 MS
6,819,288 B2 * 11/2004 Truthan ..... 343/700 MS
6,995,709 B2 * 2/2006 Spittler ..... 343/700 MS
7,202,817 B2 * 4/2007 Shinkai et al. ..... 343/700 MS
2003/0164797 A1 * 9/2003 Ngai et al. ..... 343/700 MS
2006/0097924 A1 * 5/2006 Yegin et al. ..... 343/700 MS

* cited by examiner

*Primary Examiner*—Vibol Tan
*Assistant Examiner*—Jason Crawford
(74) *Attorney, Agent, or Firm*—Rosenberg, Klein & Lee

(57) ABSTRACT

A dual polarization antenna device for creating a dual band function, includes: a first dielectric body, a patch layer, a first phase difference changing structure, a second dielectric body, a common metal layer, a ground layer, a second phase difference changing structure, a first antenna feed pin, and a second antenna feed pin. The first dielectric body, the patch layer, the first phase difference changing structure, the common metal layer, and the first antenna feed pin are combined together to form an upper polarization antenna structure. The second dielectric body, the common metal layer, the second phase difference changing structure, and the ground layer are combined together to form a lower polarization antenna structure. Therefore, the upper polarization antenna structure and the lower polarization antenna structure are combined to create both the dual polarization and the dual band functions.

16 Claims, 8 Drawing Sheets

DUAL POLARIZATION ANTENNA DEVICE FOR CREATING A DUAL BAND FUNCTION

BACKGROUND OF THE INVENTION

1. Field of the Invention

The present invention relates to an antenna device, and particularly relates to a dual polarization antenna device for creating a dual band function.

2. Description of the Related Art

Due to the development of communication technology, a lot of electronic products have been developed that use wireless communication technology, such as cell phones, wireless Internet devices, and personal digital assistants (PDAs), etc. The requirements demanded by the wireless communication devices from consumers has become higher and higher, namely in terms of the appearance and the dimensions of the devices. For cell phones, the receiving frequency has developed from a single frequency, to two, then three, and now four frequencies. Consumers also prefer cell phones which have a fresh appearance, small dimensions, a light weight, and are portable.

Moreover, an antenna with dual polarization and dual band functions is disclosed due to the progress of communication technology. Dual band function means that the antenna can be used in two different bands. The antenna will generate peak points of gain in the two different bands, and the antenna's impedance is matched.

SUMMARY OF THE INVENTION

One particular aspect of the present invention is to provide a dual polarization antenna device for creating a dual band function. The present invention provides two types of dual polarization structures and the two dual polarization structures share a common metal layer to create both the dual polarization and the dual band functions for user to use.

In order to achieve the above-mentioned aspects, the first embodiment of the present invention provides a dual polarization antenna device for creating a dual band function, comprising: a first dielectric body, a patch layer, a first phase difference changing structure, a second dielectric body, a common metal layer, a ground layer, a second phase difference changing structure, a first antenna feed pin, and a second antenna feed pin.

Moreover, the patch layer is formed on a top surface of the first dielectric body. The first phase difference changing structure is formed on the patch layer. The common metal layer is formed between the first dielectric body and the second dielectric body. The ground layer is formed on a bottom surface of the second dielectric body. The second phase difference changing structure is formed in an inner portion and on the bottom surface of the second dielectric body. The first antenna feed pin penetrates the first dielectric body and the second dielectric body in sequence. The second antenna feed pin penetrates the second dielectric body.

Therefore, the first dielectric body, the patch layer, the first phase difference changing structure, the common metal layer, and the first antenna feed pin are combined together to form an upper polarization antenna structure. The second dielectric body, the common metal layer, the second phase difference changing structure, and the ground layer are combined together to form a lower polarization antenna structure.

In order to achieve the above-mentioned aspects, the second embodiment of the present invention provides a dual polarization antenna device for creating a dual band function. The difference between the second embodiment and the first embodiment is that the second embodiment lacks a first phase difference changing structure. Hence, the first dielectric body, the patch layer, the common metal layer, and the first antenna feed pin are combined together to form an upper polarization antenna structure.

In order to achieve the above-mentioned aspects, the third embodiment of the present invention provides a dual polarization antenna device for creating a dual band function. The difference between the third embodiment and the first embodiment is that a second phase difference changing structure is formed on a common metal layer.

In order to achieve the above-mentioned aspects, the fourth embodiment of the present invention provides a dual polarization antenna device for creating a dual band function. The difference between the fourth embodiment and the first embodiment is that the fourth embodiment lacks a first phase difference changing structure and a second phase difference changing structure. Hence, the first dielectric body, the patch layer, the common metal layer, and the first antenna feed pin are combined together to form an upper polarization antenna structure. The second dielectric body, the common metal layer, the ground layer, and the second antenna feed pin are combined together to form a lower polarization antenna structure.

In conclusion, the upper polarization antenna structure and the lower polarization antenna structure are combined to create both the dual polarization and the dual band functions.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The various objects and advantages of the present invention will be more readily understood from the following detailed description when read in conjunction with the appended drawings, in which.

DETAILED DESCRIPTION OF THE PREFERRED EMBODIMENTS

Figure 1:
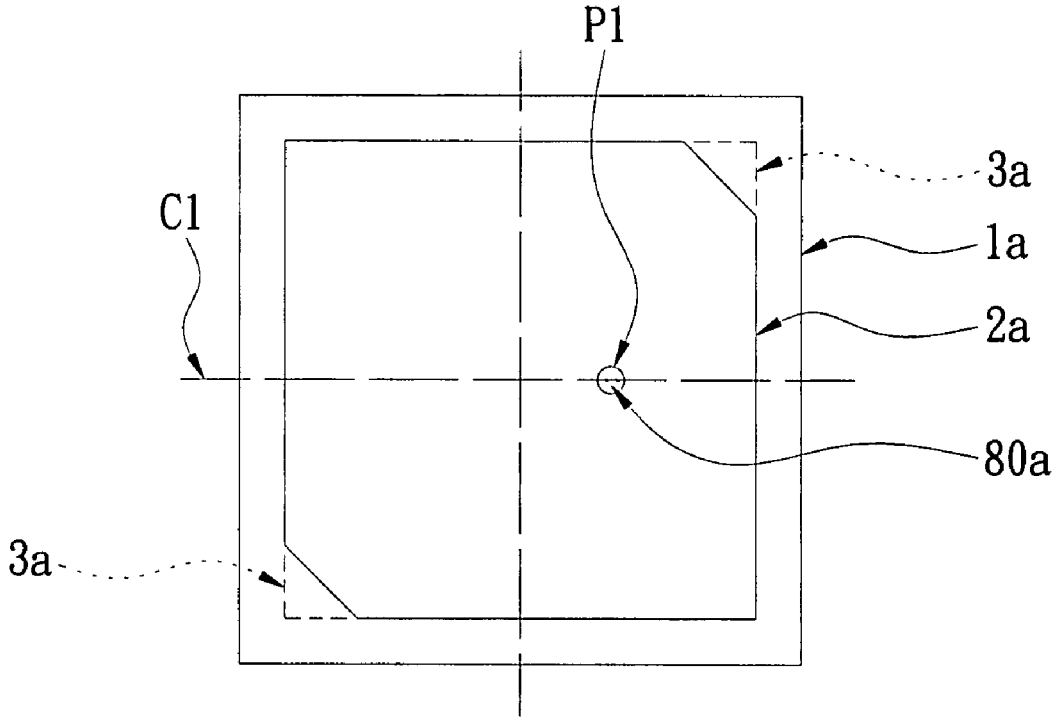
FIG. 1 is top view of the first part according to the first embodiment of the present invention.
Figure 2:
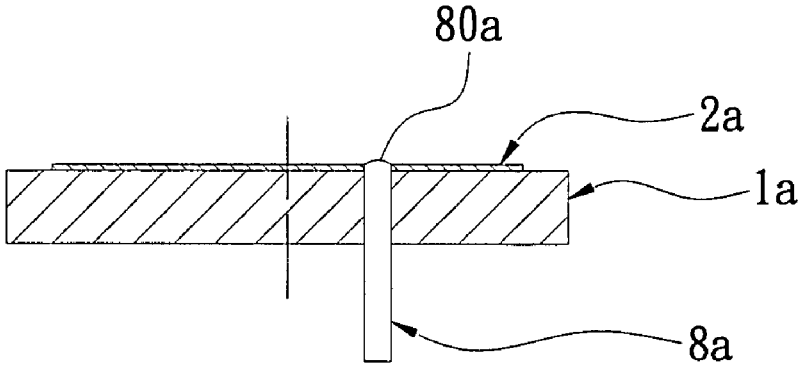
FIG. 2 is a side, cross-sectional view of the first part according to the first embodiment of the present invention.
Figure 3:
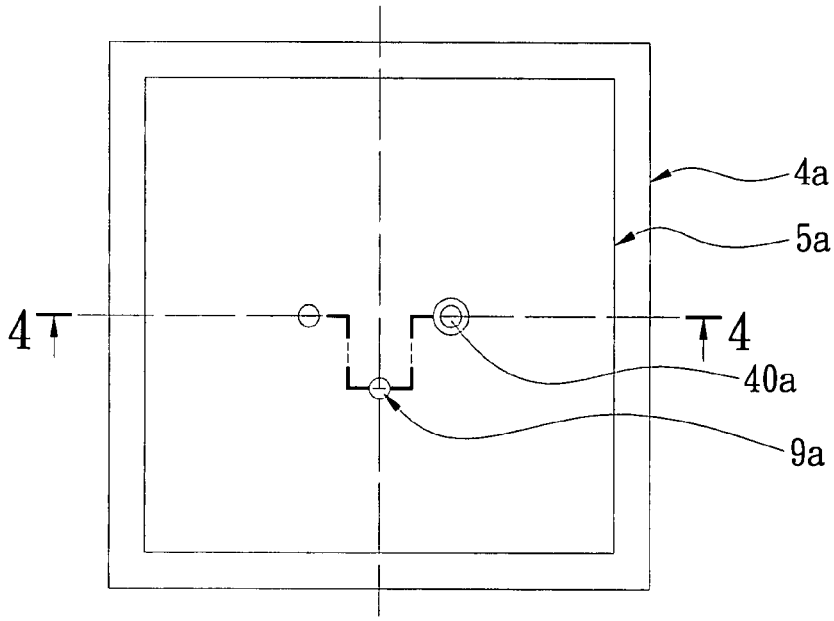
FIG. 3 is top view of the second part according to the first embodiment of the present invention.
Figure 4:
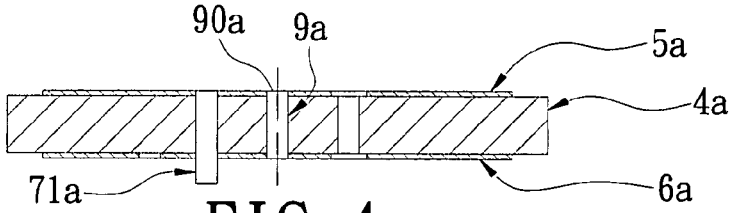
FIG. 4 is a side, cross-sectional view of the second part according to the first embodiment of the present invention.
Figure 5:
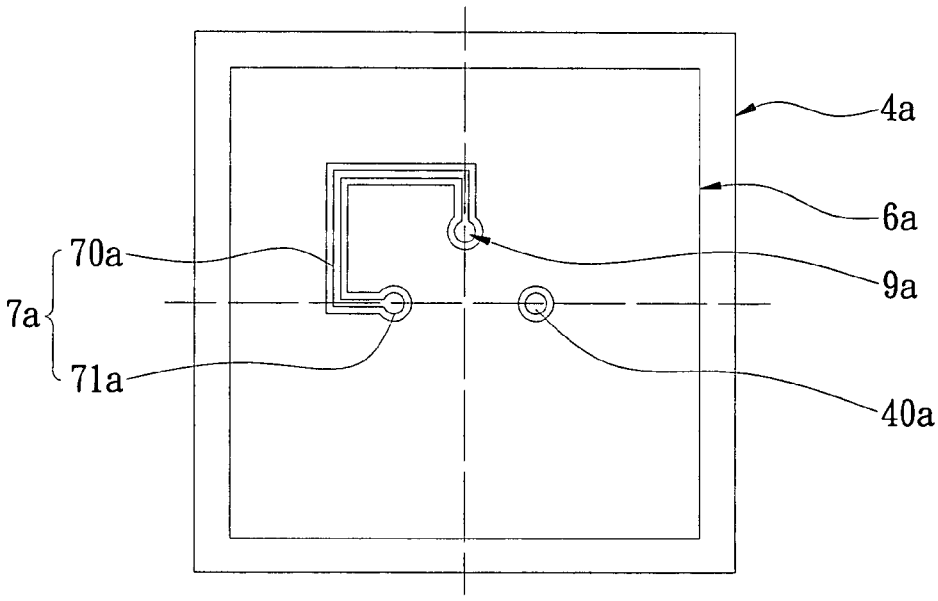
FIG. 5 is bottom view of the second part according to the first embodiment of the present invention.
Figure 6:
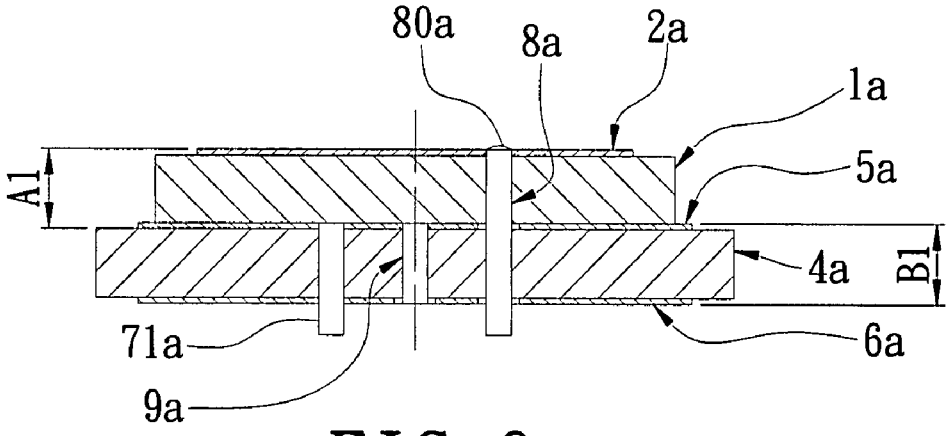
FIG. 6 is a side, cross-sectional view of a combination of the first part and the second part according to the first embodiment of the present invention.
Figure 7:
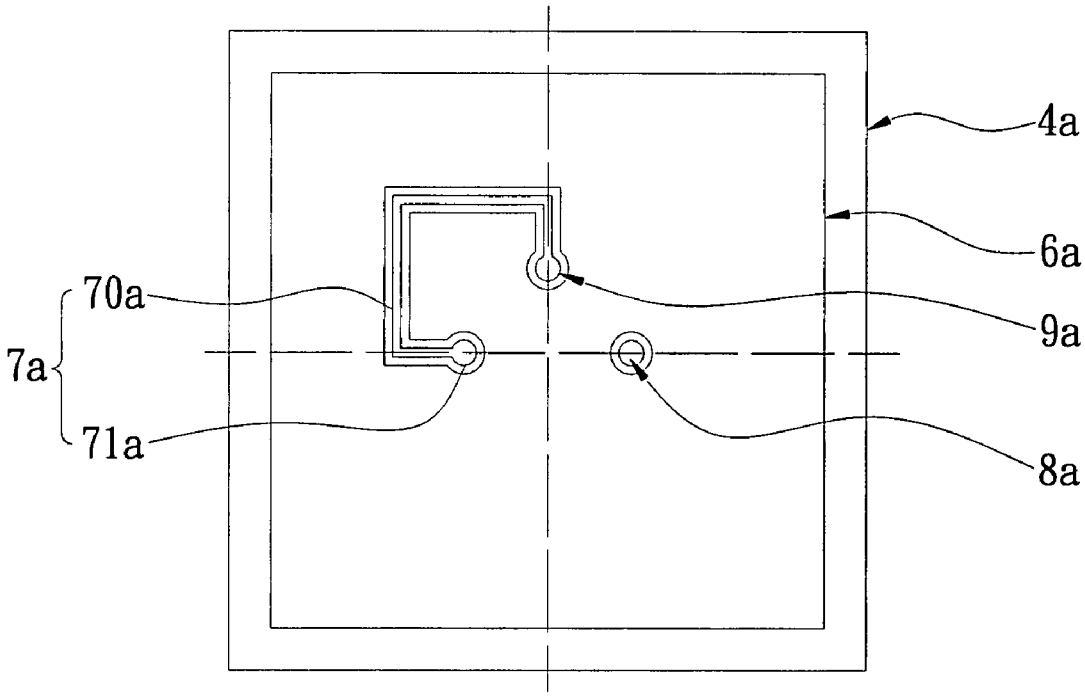
FIG. 7 is a bottom view of a combination of the first part and the second part according to the first embodiment of the present invention.

Referring to FIGS. 1 to 7, the first embodiment of the present invention provides a dual polarization antenna device for creating a dual band function, including: a first dielectric body 1*a*, a patch layer 2*a*, a first phase difference changing structure 3*a*, a second dielectric body 4*a*, a common metal layer 5*a*, a ground layer 6*a*, a second phase difference changing structure 7*a*, a first antenna feed pin 8*a*, and a second antenna feed pin 9*a*. The first phase difference changing structures 3*a* and the second phase difference changing structures 7*a* are 90 degree phase difference changing structures.

Referring to FIGS. 1 and 2 again, the first part of the first embodiment of the present invention is disclosed. The first dielectric body 1*a* is made of dielectric material, and the dielectric material can be a ceramic material or an insulative material, etc. The patch layer 2*a* is formed on a top surface of the first dielectric body 1*a*. The first phase difference changing structure 3*a* is formed on the patch layer 2*a*.

For the first embodiment, the first phase difference changing structure 3*a* is a pair of cutting areas that are formed on two diagonal edges of the patch layer 2*a*. The pair of cutting areas is a pair of triangular areas of the same size. In other words, the patch layer 2*a* has a square shape and is formed on the first dielectric body 1*a*. The pair of cutting areas on the two diagonal edges of the patch layer 2*a* need to be cut to generate the 90 degree phase difference. In addition, a top side of the first antenna feed pin 8*a* is exposed outside of the patch layer 2*a* to form a first feed point 80*a*. The first feed point 80*a* is disposed on a two opposite sides center line C1 of the patch layer 2*a*. A position P1 of the first feed point 80*b* is close to a center point of the two opposite sides center line C1 as FIG. 1.

Referring to FIGS. 3 to 5 again, the second part of the first embodiment of the present invention is disclosed. The second dielectric body 4*a* is also made of dielectric material. The dielectric material can be a ceramic material or an insulative material, etc. The second dielectric body 4*a* has a through hole 40*a* corresponding to the first antenna feed pin 8*a*. The common metal layer 5*a* is formed on a top surface of the second dielectric body 4*a*. The ground layer 6*a* is formed on a bottom surface of the second dielectric body 4*a*.

The second phase difference changing structure 7*a* is formed in an inner portion and on the bottom surface of the second dielectric body 4*a*. The second phase difference changing structure 7*a* includes a metal leading wire 70*a* and an antenna pin 71*a*. The ground layer 6*a* has an exposed area for exposing the second dielectric body 4*a*. Hence, the metal leading wire 70*a* is formed in the exposed area and on the bottom surface of the second dielectric body 4*a* and is insulated from the ground layer 6*a* to form a coplanar waveguide. One side of the metal leading wire 70*a* is electrically connected with a bottom side of the second antenna feed pin 9*a*, while the other side of the metal leading wire 70*a* is electrically connected with the antenna pin 71*a*.

The antenna pin 71*a* penetrates the second dielectric body 4*a*. A top side of the antenna pin 71*a* is exposed outside of the common metal layer 5*a*. A bottom side of the antenna pin 71*a* extends from a bottom surface of ground layer 6*a*.

A top side of the second antenna feed pin 9*a* is exposed outside of the common metal layer 5*a* to form a second feed point 90*a*. A bottom side of the second antenna feed pin 9*a* is exposed outside of a bottom surface of the ground layer 6*a*.

Referring to FIGS. 6 to 7 again, when the first part and the second part are combined together, the common metal layer 5*a* is formed between the first dielectric body 1*a* and the second dielectric body 4*a*. The first antenna feed pin 8*a* penetrates the first dielectric body 1*a* and the second dielectric body 4*a* in sequence. The bottom side of the first antenna feed pin 8*a* extends from the bottom surface of the ground layer 6*a*. The first antenna feed pin 8*a* is insulated from the common metal layer 5*a* and the ground layer 6*a*. The second antenna feed pin 9*a* penetrates the second dielectric body 4*a*, and the second antenna feed pin 9*a* is insulated from the ground layer 6*a*.

The first part and the second part share the common metal layer 5*a*. Hence, the first dielectric body 1*a*, the patch layer 2*a*, the first phase difference changing structure 3*a*, the common metal layer 5*a*, and the first antenna feed pin 8*a* are combined together to form an upper polarization antenna structure A1. The second dielectric body 4*a*, the common metal layer 5*a*, the second phase difference changing structure 7*a*, and the ground layer 6*a* are combined together to form a lower polarization antenna structure B1.

Therefore, the upper polarization antenna structure A1 and the lower polarization antenna structure B1 are combined to create both the dual polarization and the dual band functions.

Referring to FIGS. 8 to 14, the second embodiment of the present invention provides a dual polarization antenna device for creating a band function. It means the present invention allows users to use dual polarization and dual band technologies. The device includes: a first dielectric body 1*b*, a patch layer 2*b*, a first phase difference changing structure 3*a*, a second dielectric body 4*b*, a common metal layer 5*b*, a ground layer 6*b*, a second phase difference changing structure 7*a*, a first antenna feed pin 8*b*, and a second antenna feed pin 9*a*

Figure 8:
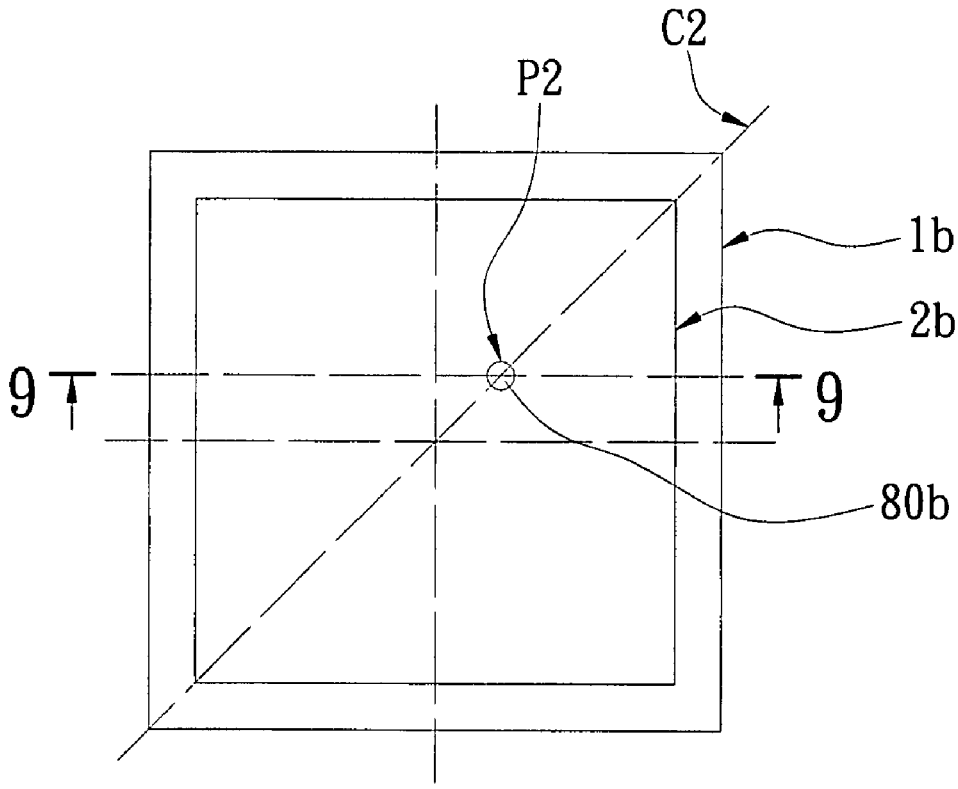
FIG. 8 is top view of the first part according to the second embodiment of the present invention.
Figure 9:
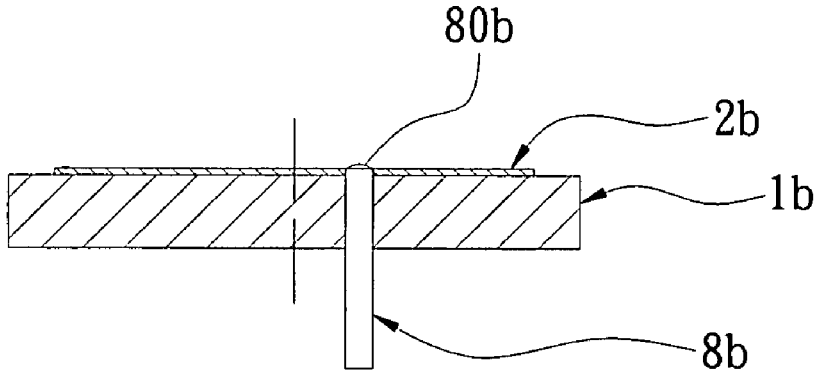
FIG. 9 is a side, cross-sectional view of the first part according to the second embodiment of the present invention.
Figure 10:
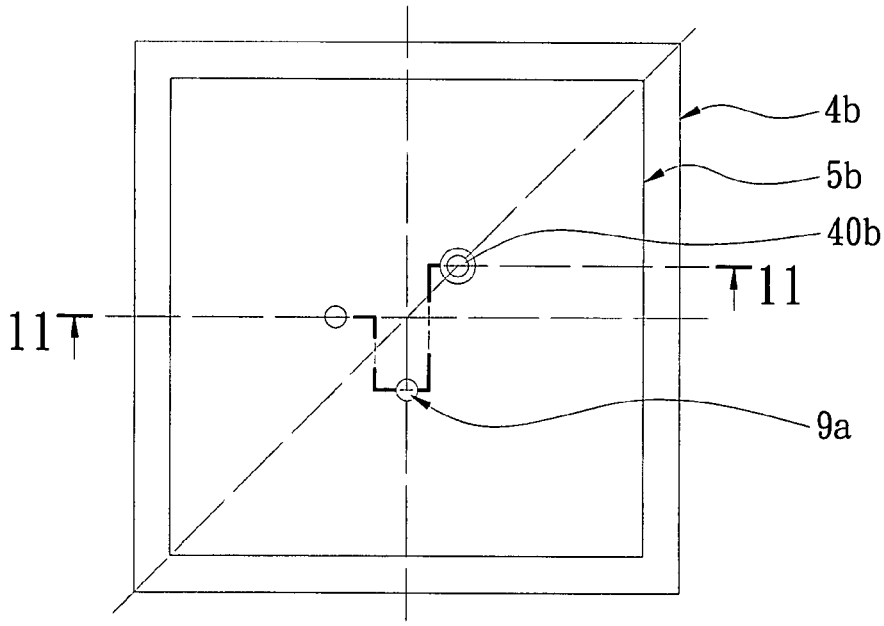
FIG. 10 is top view of the second part according to the second embodiment of the present invention.
Figure 11:
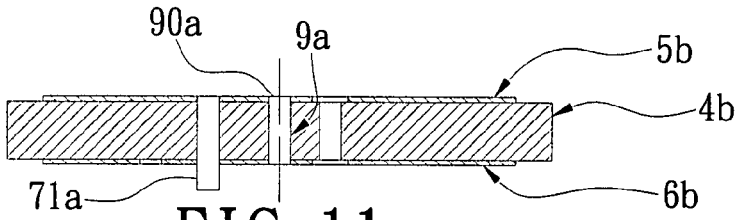
FIG. 11 is a side, cross-sectional view of the second part according to the second embodiment of the present invention.
Figure 12:
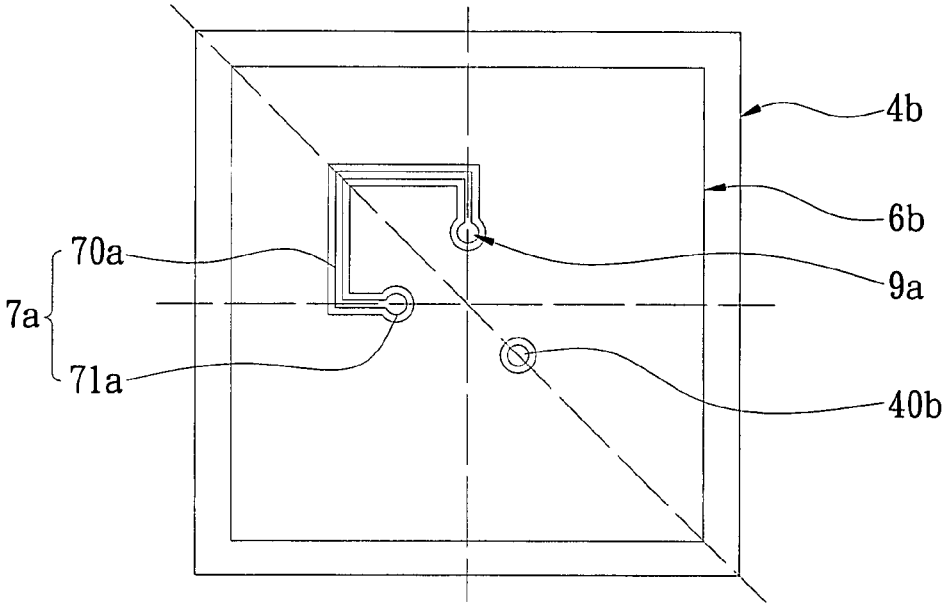
FIG. 12 is bottom view of the second part according to the second embodiment of the present invention.
Figure 13:
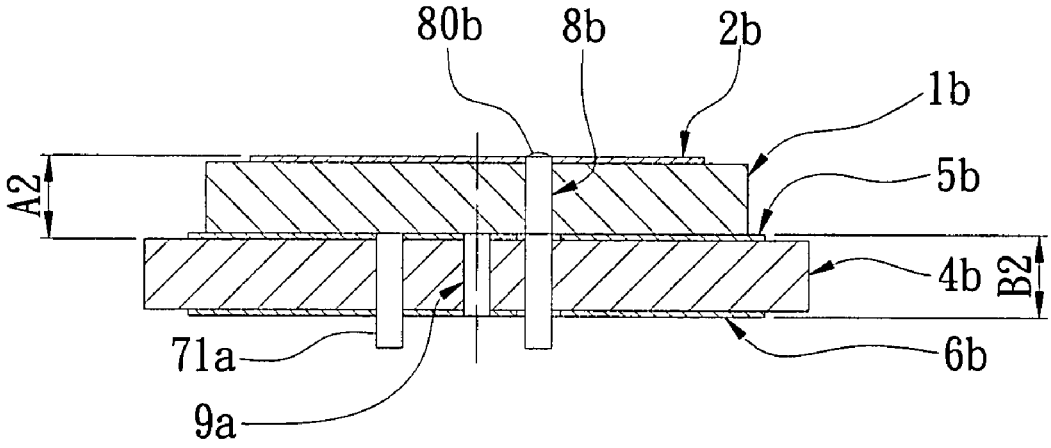
FIG. 13 is a side, cross-sectional view of a combination of the first part and the second part according to the second embodiment of the present invention.
Figure 14:
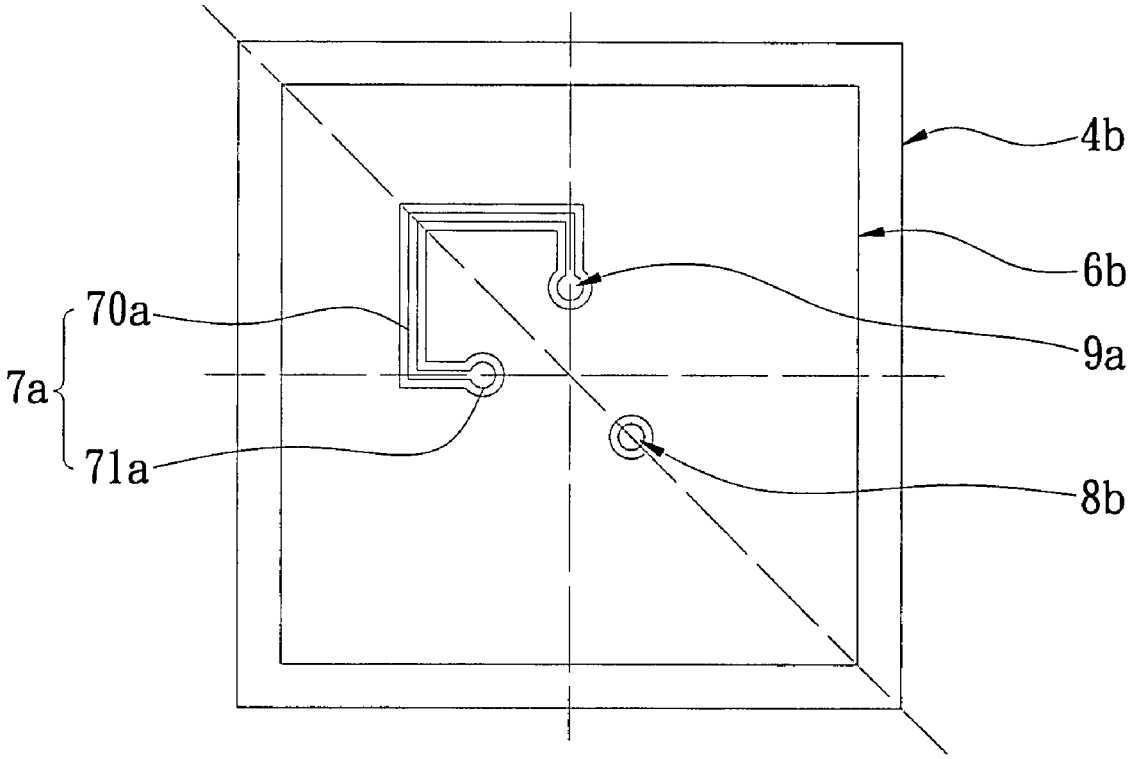
FIG. 14 is a bottom view of a combination of the first part and the second part according to the second embodiment of the present invention.

Referring to FIGS. 8 to 9 again, with regard to the first part of the second embodiment, the difference between the second embodiment and the first embodiment is that the first antenna feed pin 8*b* has a first feed point 80*b* exposed outside of the patch layer 2*b*. The first feed point 80*b* is disposed on a diagonal edge center line C2 of the patch layer 2*b*. A position P2 of the first feed point 80*b* is close to a center point of the diagonal edge center line C2 (as shown in FIG. 8) for generating 90 degree phase difference.

Referring to FIGS. 8 to 14 again, with regard to the second part of the second embodiment, the difference between the second embodiment and the first embodiment is that because the position of the first feed point 80*b* is changed, the position of a through hole 40*b* of the second dielectric body 4*b* is changed.

The first part and the second part share the common metal layer 5*b*. Hence, the first dielectric body 1*b*, the patch layer 2*b*, the common metal layer 5*b*, and the first antenna feed pin 8*b* are combined together to form an upper polarization antenna structure A2. The second dielectric body 4*b*, the common metal layer 5*b*, the second phase difference changing structure 7*a*, and the ground layer 6*b* are combined together to form a lower polarization antenna structure B2.

Therefore, the upper polarization antenna structure A2 and the lower polarization antenna structure B2 are combined to create both the dual polarization and the dual band functions.

According to the above-mentioned two embodiments, for the upper polarization antenna structure A1, the shape of the patch layer 2*a* and the position P1 of the first feed point 80*a* of the first antenna feed pin 8*a* are mated in order to create dual polarization and dual band functions. For the upper polarization antenna structure A2, the position P2 of the first feed point 80*b* of the first antenna feed pin 8*b* can create dual polarization and dual band functions directly.

Figure 15:
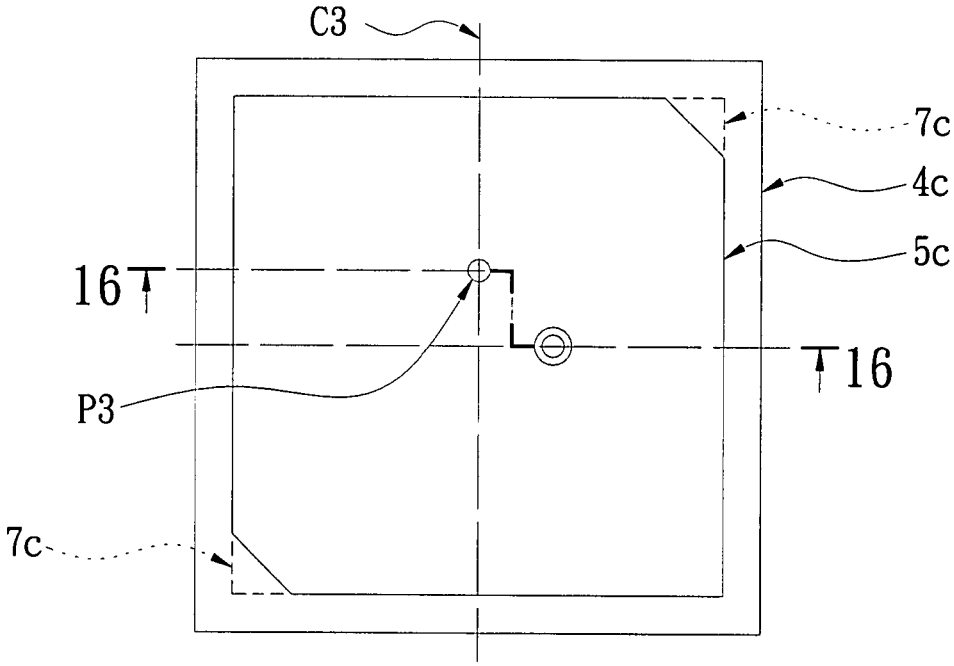
FIG. 15 is top view of the second part according to the third embodiment of the present invention.
Figure 16:
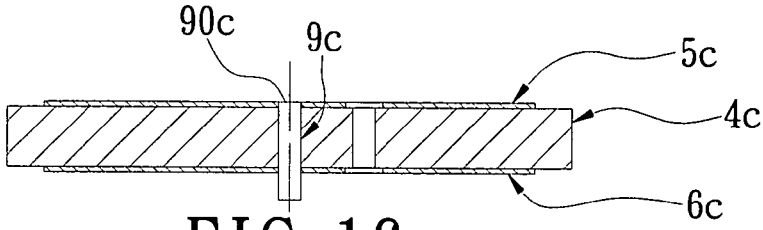
FIG. 16 is a side, cross-sectional view of the second part according to the third embodiment of the present invention.
Figure 17:
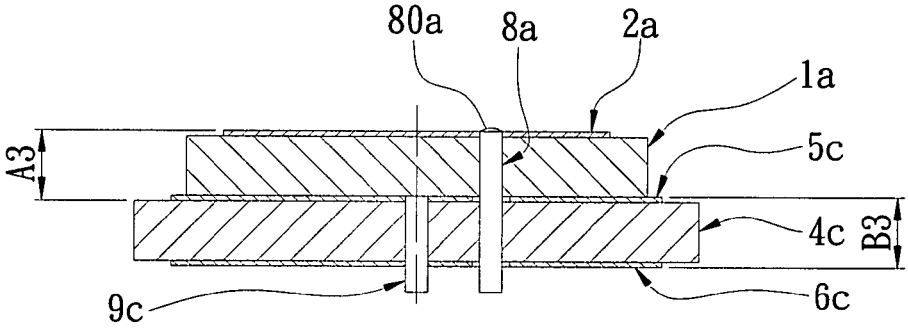
FIG. 17 is a side, cross-sectional view of a combination of the first part of the first embodiment and the second part of the third embodiment.

Referring to FIGS. 15 to 17, the second part of the third embodiment of the present invention includes: a second dielectric body 4*c*, a common metal layer 5*c*, a ground layer 6*c*, a second phase difference changing structure 7*c*, and a second antenna feed pin 9*c*. The second phase difference changing structure 7*c* is a pair of cutting areas that are formed on two diagonal edges of the common metal layer 5*c*. The pair of cutting areas is a pair of triangular areas of the same size. In other words, the common metal layer 5*c* has a square shape and is formed on the second dielectric body 4*a*. The pair of cutting areas on the two diagonal edges of the common metal layer 5*c* needs to be cut for generating 90 degree phase difference. In addition, the second antenna feed pin 9*c* extends from a bottom surface of the ground layer 6*c*. The second antenna feed pin 9*c* has a second feed point 90*c* exposed outside of the common metal layer 5*c*. The second feed point 90*c* is disposed on a two opposite sides center line C3 of the common metal layer 5*c*. A position P3 of the second feed point 90*c* is close to a center point of the two opposite sides center line C3 (as is shown in FIG. 15).

The first part of the first embodiment and the second part of the third embodiment are combined together. Therefore, the first dielectric body 1*a*, the patch layer 2*a*, the first phase difference changing structure 3*a* (as shown in FIG. 1), the common metal layer 5*c*, and the first antenna feed pin 8*a* are combined together to form an upper polarization antenna structure A3. The second dielectric body 4*c*, the common metal layer 5*c*, the second phase difference changing structure 7*c*, and the ground layer 9*c* are combined together to form a lower polarization antenna structure B3.

Therefore, the upper polarization antenna structure A3 and the lower polarization antenna structure B3 are combined to create both the dual polarization and the dual band functions.

Figure 18:
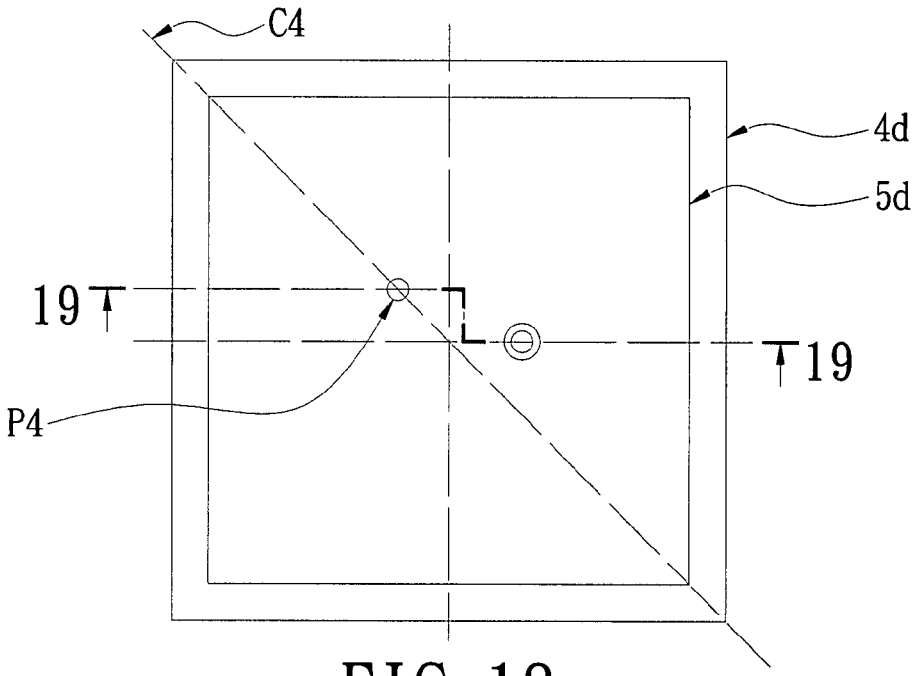
FIG. 18 is top view of the second part according to the fourth embodiment of the present invention.
Figure 19:
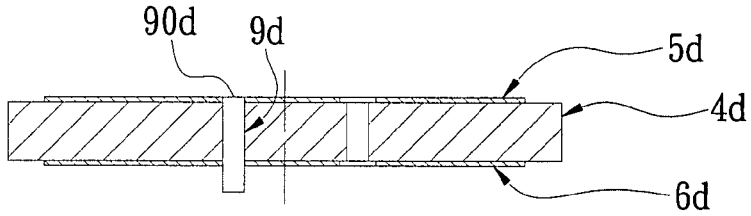
FIG. 19 is a side, cross-sectional view of the second part according to the fourth embodiment of the present invention.
Figure 20:
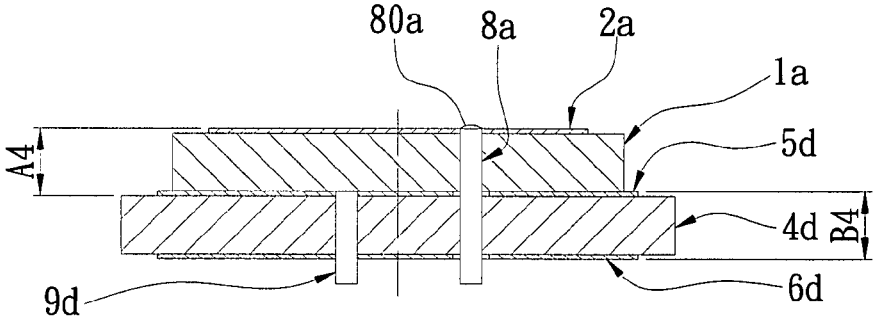
FIG. 20 is a side, cross-sectional view of a combination of the first part of the first embodiment and the second part of the fourth embodiment.

Referring to FIGS. 18 to 20, the second part of the fourth embodiment of the present invention includes: a second dielectric body 4*d*, a common metal layer 5*d*, a ground layer 6*d*, and a second antenna feed pin 9*d*. The second antenna feed pin 9*d* extends from a bottom surface of the ground layer 6*d*. The second antenna feed pin 9*d* has a second feed point 90*d* exposed outside of the common metal layer 5*d*. The second feed point 90*d* is disposed on a diagonal edge center line C4 of the common metal layer 5*d*. A position P4 of the second feed point 90*d* is close to a center point of the diagonal edge center line C4 as FIG. 18 for generating 90 degree phase difference.

The first part of the first embodiment and the second part of the fourth embodiment are combined together. Therefore, the first dielectric body 1*a*, the patch layer 2*a*, the first phase difference changing structure 3*a* (as shown in FIG. 1), the common metal layer 5*d*, and the first antenna feed pin 8*a* are combined together to form an upper polarization antenna structure A4. The second dielectric body 4*d*, the common metal layer 5*d*, and the ground layer 9*d* are combined together to form a lower polarization antenna structure B4.

Therefore, the upper polarization antenna structure A4 and the lower polarization antenna structure B4 are combined to create both the dual polarization and the dual band functions.

Although the present invention has been described with reference to the preferred best molds thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A dual polarization antenna device for creating a dual band function, comprising:

a first dielectric body;

a patch layer formed on a top surface of the first dielectric body;

a first phase difference changing structure formed on the patch layer;

a second dielectric body;

a common metal layer formed between the first dielectric body and the second dielectric body;

a ground layer formed on a bottom surface of the second dielectric body;

a second phase difference changing structure formed in an inner portion and on the bottom surface of the second dielectric body, the second phase difference changing structure including a metal leading wire and an antenna pin, the metal leading wire being formed on a bottom surface of the second dielectric body and insulated from the ground layer;

a first antenna feed pin penetrating the first dielectric body and the second dielectric body in sequence; and a second antenna feed pin penetrating the second dielectric body, one side of the metal leading wire being electrically connected with a bottom side of the second antenna feed pin, and the other side of the metal leading wire being electrically connected with the antenna pin;

wherein the first dielectric body, the patch layer, the first phase difference changing structure, the common metal layer, and the first antenna feed pin are combined together to form an upper polarization antenna structure;

wherein the second dielectric body, the common metal layer, the second phase difference changing structure, and the ground layer are combined together to form a lower polarization antenna structure;

whereby, the upper polarization antenna structure and the lower polarization antenna structure are combined to create both the dual polarization and the dual band functions.

2. The dual polarization antenna device as claimed in claim 1, wherein the first dielectric body and the second dielectric body are made of a dielectric material.

3. The dual polarization antenna device as claimed in claim 2, wherein the dielectric material is a ceramic material or an insulative material.

4. The dual polarization antenna device as claimed in claim 1, wherein the first and the second phase difference changing structures are 90 degree phase difference changing structures.

5. The dual polarization antenna device as claimed in claim 1, wherein the first phase difference changing structure is a pair of cuffing areas that are formed on two diagonal edges of the patch layer.

6. The dual polarization antenna device as claimed in claim 5, wherein the pair of cuffing areas is a pair of triangular areas of the same size.

7. The dual polarization antenna device as claimed in claim 1, wherein a top side of the first antenna feed pin is exposed outside of the patch layer to form a first feed point, a bottom side of the first antenna feed pin extends from a bottom surface of the ground layer, and the first antenna feed pin is insulated from the common metal layer and the ground layer.

8. The dual polarization antenna device as claimed in claim 7, wherein the first feed point is disposed on a two opposite sides center line of the patch layer and is close to a center point of the two opposite sides center line.

9. The dual polarization antenna device as claimed in claim 1, wherein a top side of the second antenna feed pin is exposed outside of the common metal layer to form a second feed point, a bottom side of the second antenna feed pin is exposed outside of a bottom surface of the ground layer, and the second antenna feed pin is insulated from the ground layer.

10. A dual polarization antenna device for creating a dual band function, comprising:

a first dielectric body;

a patch layer formed on a top surface of the first dielectric body;

a second dielectric body;

a common metal layer formed between the first dielectric body and the second dielectric body;

a ground layer formed on a bottom surface of the second dielectric body;

a second phase difference changing structure formed in an inner portion and on the bottom surface of the second dielectric body, the second phase difference changing structure including a metal leading wire and an antenna pin, the metal leading wire being formed on a bottom surface of the second dielectric body and insulated from the ground layer;

a first antenna feed pin penetrating the first dielectric body and the second dielectric body in sequence; and a second antenna feed pin penetrating the second dielectric body, one side of the metal leading wire being electrically connected with a bottom side of the second antenna feed pin, and the other side of the metal leading wire being electrically connected with the antenna pin;

wherein the first dielectric body, the patch layer, the common metal layer, and the first antenna feed pin are combined together to form an upper polarization antenna structure;

wherein the second dielectric body, the common metal layer, the second phase difference changing structure, and the ground layer are combined together to form a lower polarization antenna structure;

whereby, the upper polarization antenna structure and the lower polarization antenna structure are combined to create both the dual polarization and the dual band functions.

11. The dual polarization antenna device as claimed in claim 10, wherein the first dielectric body and the second dielectric body are made of a dielectric material.

12. The dual polarization antenna device as claimed in claim 11, wherein the dielectric material is a ceramic material or an insulative material.

13. The dual polarization antenna device as claimed in claim 10, wherein the second phase difference changing structure is 90 degree phase difference changing structure.

14. The dual polarization antenna device as claimed in claim 10, wherein a top side of the first antenna feed pin is exposed outside of the patch layer to form a first feed point, a bottom side of the first antenna feed pin extends from a bottom surface of the ground layer, and the first antenna feed pin is insulated from the common metal layer and the ground layer.

15. The dual polarization antenna device as claimed in claim 14, wherein the first feed point is disposed on a diagonal edge center line of the patch layer and is close to a center point of the diagonal edge center line.

16. The dual polarization antenna device as claimed in claim 10, wherein a top side of the second antenna feed pin is exposed outside of the common metal layer to form a second feed point, a bottom side of the second antenna feed pin is exposed outside of a bottom surface of the ground layer, and the second antenna feed pin is insulated from the ground layer.

* * * * *